US008198960B2

(12) United States Patent
Washiro

(10) Patent No.: US 8,198,960 B2
(45) Date of Patent: Jun. 12, 2012

(54) ELECTRIC FIELD COUPLER, COMMUNICATION APPARATUS, COMMUNICATION SYSTEM, AND FABRICATION METHOD FOR ELECTRIC FIELD COUPLER

(75) Inventor: Takanori Washiro, Kanagawa (JP)

(73) Assignee: Sony Corporation, Tokyo (JP)

( * ) Notice: Subject to any disclaimer, the term of this patent is extended or adjusted under 35 U.S.C. 154(b) by 244 days.

(21) Appl. No.: 12/505,730

(22) Filed: Jul. 20, 2009

(65) Prior Publication Data

US 2010/0019871 A1 Jan. 28, 2010

(30) Foreign Application Priority Data

Jul. 28, 2008 (JP) ..... P2008-193930

(51) Int. Cl.
*H01P 3/08* (2006.01)
*H01P 7/00* (2006.01)

(52) U.S. Cl. ..... 333/204; 333/219

(58) Field of Classification Search ..... 333/236, 333/238, 204, 219
See application file for complete search history.

(56) References Cited

U.S. PATENT DOCUMENTS 2,482,767 A 9/1949 Hansen
3,417,403 A 12/1968 Fenwick
5,390,283 A 2/1995 Eshelman et al.
6,122,533 A * 9/2000 Zhang et al. ..... 505/210
2003/0222732 A1* 12/2003 Matthaei ..... 333/99 S

FOREIGN PATENT DOCUMENTS

| | | |
|---|---|---|
| EP | 0 777 293 A1 | 6/1997 |
| EP | 0 923 153 A1 | 6/1999 |
| EP | 1 178 561 A2 | 2/2002 |
| JP | 5-31188 | 4/1993 |
| JP | 9-71189 | 3/1997 |
| JP | 11-214914 | 8/1999 |
| JP | 2001-223519 | 8/2001 |
| JP | 2003-188623 | 7/2003 |
| JP | 2008-99236 | 4/2008 |
| WO | WO 99/03166 | 1/1999 |
| WO | WO 02/49151 A1 | 6/2002 |

OTHER PUBLICATIONS

European Search Report in EP 09 25 1671 dated Oct. 15, 2009.

* cited by examiner

*Primary Examiner* — Dean O Takaoka
(74) *Attorney, Agent, or Firm* — Finnegan, Henderson, Farabow, Garrett & Dunner, L.L.P.

(57) ABSTRACT

An electric field coupler includes a strip-like coil formed by bending a strip-like conductor which snakes along a plane perpendicular to a coupling direction in which electric field coupling occurs, such that coil axes are perpendicular to the coupling direction, the strip-like coil having an electrical length of one-half wavelength of a predetermined frequency of a radio-frequency signal and having a form in which the coil axes surround a central portion along the plane. The strip-like coil produces coupling by a longitudinal wave electric field which vibrates in the coupling direction at the central portion.

6 Claims, 13 Drawing Sheets

ELECTRIC FIELD COUPLER, COMMUNICATION APPARATUS, COMMUNICATION SYSTEM, AND FABRICATION METHOD FOR ELECTRIC FIELD COUPLER

BACKGROUND OF THE INVENTION

1. Field of the Invention

The present invention relates to an electric field coupler, a communication apparatus, a communication system, and a fabrication method for an electric field coupler.

2. Description of the Related Art

In recent years, communication apparatuses that perform contactless communication, such as contactless type IC (Integrated Circuit) cards and RFID (Radio Frequency IDentification), have proliferated. Such communication apparatuses that perform contactless communication include one that produces magnetic field coupling and one that produces electric field coupling.

In the case of producing magnetic field coupling, a communication apparatus has, for example, an antenna coil and performs contactless communication by magnetic field coupling using an alternating-current magnetic field at the antenna coil. On the other hand, in the case of producing electric field coupling, a communication apparatus has, for example, a plate-like electric field coupling electrode (coupler) and performs contactless communication by electric field coupling using an electrostatic field or induction field generated by the electric field coupling electrode (see, for example, Japanese Patent Application Laid-Open No. 2008-99236). Such communication apparatuses are suitable for short-range contactless communication such as a short-range type. Communication apparatuses that can be used for the aforementioned contactless type IC cards, etc., are mounted on cards, portable devices, etc., and are thus formed to be slim and compact.

SUMMARY OF THE INVENTION

In the aforementioned communication apparatus that produces magnetic field coupling, when there is a metal plate, etc., on the back of the antenna coil, communication may not be able to be performed and also a large area may be required on a plane where the antenna coil is disposed. On the other hand, in the aforementioned communication apparatus that produces electric field coupling, electric field coupling occurs by a communication partner's electrode and the electric field coupling electrode facing each other at short range. By providing a ground made of metal in a direction opposite to a coupling direction, as viewed from the electric field coupling electrode, radiation of an unwanted electric field signal in a back direction can be prevented; however, when the distance between the electrode and the ground is reduced, the intensity of an electric field generated at the front of the electrode is reduced and thus it is difficult to reduce the profile. Also, since such communication apparatuses that perform contactless communication are often mounted on, for example, contactless type IC cards and portable devices such as mobile phones, miniaturization, particularly, a reduction in profile, are desired.

Meanwhile, for communication apparatuses, it is important not only to achieve miniaturization but also to achieve easy fabrication. For example, when a coil in which a linear conductor is helically wound, or the like, is used as an antenna, the thickness of a communication apparatus increases by an amount corresponding to a coil cross section. Furthermore, in this case, in miniaturizing the coil, it is difficult to make the diameters of coil circles uniform and make the spacings (pitches) between the circles uniform and thus fabrication is not easy. In addition, when such nonuniformity in coil occurs, variations also occur in the resonance frequency of the coil, resulting in degradation of the electrical characteristics of the antenna.

The present invention addresses the above-identified, and other issues associated with conventional methods and apparatuses. There is a need for a novel and improved electric field coupler, communication apparatus, communication system, and fabrication method for an electric field coupler that are capable of achieving miniaturization and achieving easy fabrication without degrading electrical characteristics.

According to an embodiment of the present invention, there is provided an electric field coupler including: a strip-like coil formed by bending a strip-like conductor which snakes along a plane perpendicular to a coupling direction in which electric field coupling occurs, such that coil axes are perpendicular to the coupling direction, the strip-like coil having an electrical length of one-half wavelength of a predetermined frequency of a radio-frequency signal and having a form in which the coil axes surround a central portion along the plane, wherein the strip-like coil produces coupling by a longitudinal wave electric field which vibrates in the coupling direction at the central portion.

According to this configuration, the strip-like coil resonates with a radio-frequency signal and thereby generates alternating magnetic fields along the coil axes. At this time, since the coil axes surround the central portion, an electric field is generated at the central portion. Accordingly, by using the electric field, electric field coupling can be produced. When, in order to prevent an electric field from radiating to the back of the strip-like coil (a plane in a direction opposite to the coupling direction), a ground is provided on the back, according to the above-described configuration, alternating magnetic fields parallel to the ground and along the coil axes are not affected even when the distance between the strip-like coil and the ground is small. Thus, the electric field coupler can be formed to be small in profile and compact. Also, the strip-like coil can be easily formed by bending a strip-like conductor which snakes along a plane perpendicular to the coupling direction, such that the coil axes are perpendicular to the coupling direction. Accordingly, pitches, etc., of a strip-like coil can be formed in advance into a snaking strip-like conductor and thus fabrication can be performed with bending locations, etc., of the strip-like coil being precisely determined.

The strip-like coil may include two strip-like coils which are disposed such that coil axes are parallel to each other with the central portion therebetween, one end of the respective two strip-like coils being connected to each other, and winding directions of the respective strip-like coils may be reversed at a location where the two strip-like coils are connected to each other.

The electric field coupler may further include a resonance portion that resonates with a radio-frequency signal having the predetermined frequency which is supplied from a feed end and that is connected to one end of the strip-like coil at a location corresponding to an antinode of a standing wave of a voltage by the resonance; and a ground provided on one side of the strip-like coil that is opposite to the coupling direction, wherein an other end of the strip-like coil may be grounded.

A suction point where a strip width is extended may be formed at a part of the strip-like coil so that a mounter can suck the suction point upon fabrication.

The suction point may be formed at a center of gravity of the strip-like coil in the plane perpendicular to the coupling direction.

The strip-like coil may have, on a side of the coil, an overhanging portion that overhangs in a direction perpendicular to the coupling direction.

The snaking strip-like conductor may be formed by stamping a piece of sheet metal into a snaking strip-like form.

According to another embodiment of the present invention, there is provided a communication apparatus including: a strip-like coil formed by bending a strip-like conductor which snakes along a plane perpendicular to a coupling direction in which electric field coupling occurs, such that coil axes are perpendicular to the coupling direction, the strip-like coil having an effective length of one-half of a wavelength of a predetermined frequency of a radio-frequency signal and having a form in which the coil axes surround a central portion along the plane, wherein the strip-like coil performs contactless communication by producing coupling by a longitudinal wave electric field which vibrates in the coupling direction at the central portion.

According to another embodiment of the present invention, there is provided a communication system including: two communication apparatuses that perform contactless communication by producing electric field coupling, wherein at least one of the two communication apparatuses has a strip-like coil formed by bending a strip-like conductor which snakes along a plane perpendicular to a coupling direction in which the electric field coupling occurs, such that coil axes are perpendicular to the coupling direction, the strip-like coil having an electrical length of one-half wavelength of a predetermined frequency of a radio-frequency signal and having a form in which the coil axes surround a central portion along the plane, and the strip-like coil performs contactless communication by producing coupling by a longitudinal wave electric field which vibrates in the coupling direction at the central portion.

According to another embodiment of the present invention, there is provided a fabrication method for an electric field coupler, the method including the steps of: stamping a piece of sheet metal into a snaking strip-like form to form a snaking strip-like conductor, the sheet metal being perpendicular to a coupling direction in which electric field coupling occurs at a predetermined frequency; and bending the snaking strip-like conductor such that coil axes are perpendicular to the coupling direction, to form a strip-like coil having an electrical length of one-half wavelength of the predetermined frequency and having a form in which the coil axes surround a central portion.

According to the embodiments of the present invention described above, without degrading electrical characteristics, miniaturization can be achieved and easy fabrication can be achieved.

DETAILED DESCRIPTION OF THE PREFERRED EMBODIMENTS

Figure 1:
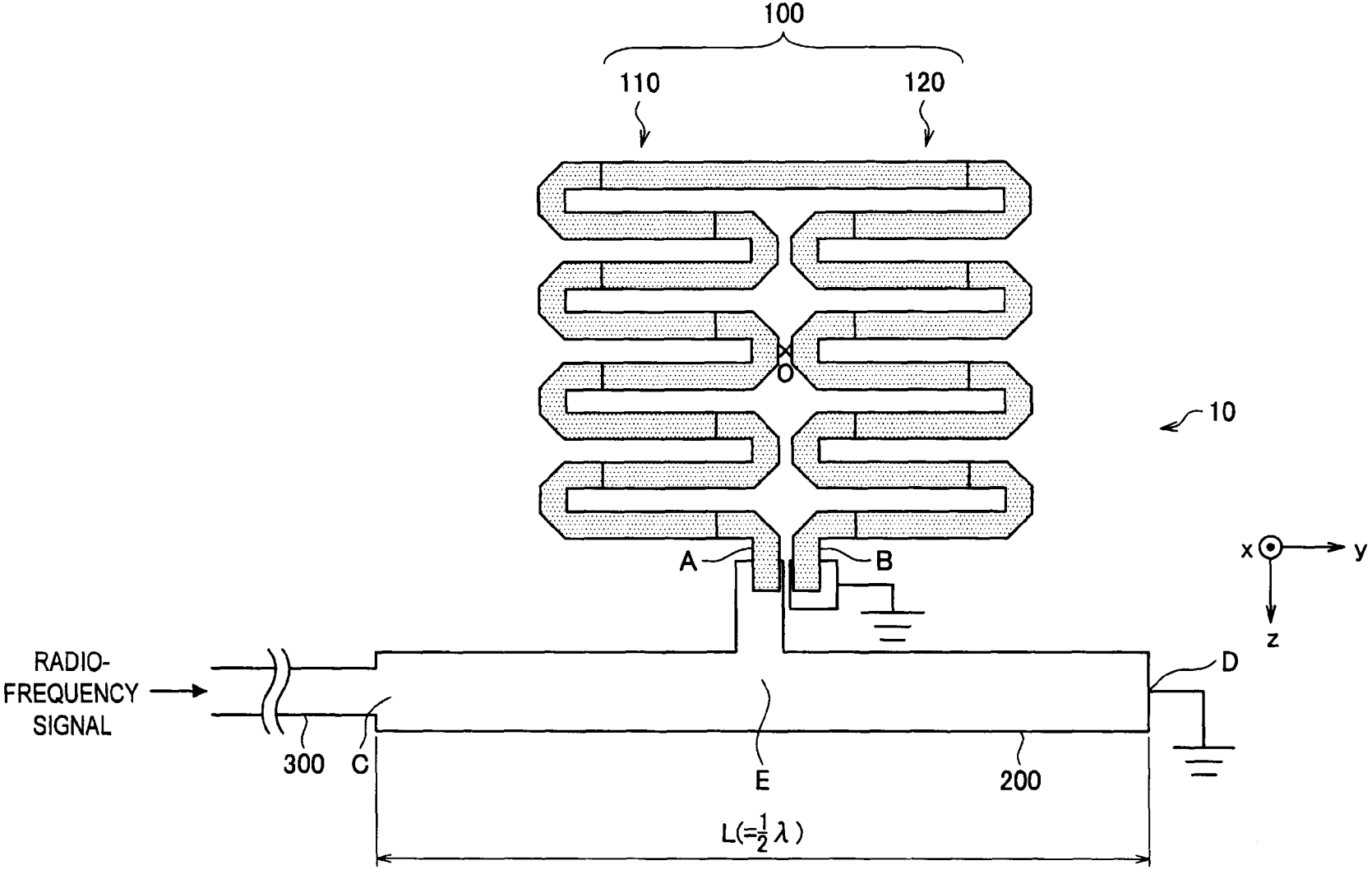
FIG. 1 is an illustrative diagram describing a configuration of an electric field coupler according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Note that, in the following, to facilitate the understanding of electric field couplers, communication apparatuses, communication systems, and fabrication methods for an electric field coupler according to embodiments of the present invention, first, a configuration of an electric field coupler according to a first embodiment that is included in the communication apparatuses and the communication systems will be described. Then, an electric field coupling electrode included in the electric field coupler will be described. Then, a fabrication method for an electric field coupler will be described and furthermore examples of the operation and effects of the electric field coupler will be described. Thereafter, as modified examples of the electric field coupler, second to fourth embodiments that have different electric field coupling electrodes will be described mainly in terms of differences between the first embodiment and the second to fourth embodiments. Specifically, in the following, description will be made in the following flow.

<1. First Embodiment>

[1.1 Configuration of an Electric Field Coupler]

[1.2 Strip-like coil (electric field coupling electrode)]

[1.3 Fabrication method for an electric field coupler]

[1.4 Examples of the operation and effects of the electric field coupler]

<2. Second Embodiment>

<3. Third Embodiment>

<4. Fourth Embodiment>

Note that, in the following, electric field couplers according to the embodiments of the present invention will be described and communication apparatuses according to the embodiments of the present invention have the electric field couplers which will be described below. In the case of communication systems according to the embodiments of the present invention, two communication apparatuses are included and at least one of the communication apparatuses has an electric field coupler and performs contactless communication by electric field coupling. As such, since the communication apparatuses, etc., according to the embodiments of the present invention are mainly characterized in their electric field couplers, in the following the electric field couplers will be mainly described. Communication devices and communication systems in which the electric field couplers are used are not particularly limited; examples thereof include contactless IC cards, RFID, and portable devices such as mobile phones and communication systems that use them.

<1. First Embodiment>

[1.1 Configuration of an electric field coupler]

FIG. 1 is an illustrative diagram describing a configuration of an electric field coupler according to a first embodiment of the present invention. As shown in FIG. 1, an electric field coupler 10 according to the present embodiment is roughly includes a strip-like coil 100, a stub 200, and an input/output line 300.

The strip-like coil 100 is an electric field coupling electrode for generating an electric field that produces electric field coupling. The strip-like coil 100 is formed in a coil-like form by a single strip-like conductor and receives a radio-frequency signal from one terminal A and the other terminal B is short-circuited. As a result, the strip-like coil 100 generates, at its central portion O, a longitudinal wave electric field in a forward direction (x-axis positive direction) orthogonal to the paper to produce electric field coupling in the forward direction. Note that the direction (x-axis positive direction) in which electric field coupling occurs is also referred to as the "coupling direction" here. Unlike a normal coil that is formed by helically winding a linear conductor, the strip-like coil 100 is formed of one piece of sheet metal. Thus, by including such a strip-like coil 100 as an electric field coupling electrode, the electric field coupler 10 can be easily fabricated and can be miniaturized and also the electrical characteristics thereof can be maintained or improved. The strip-like coil 100 will be described in detail later.

The stub 200 is an example of a resonance portion and is formed of a plate-like conductive material having a predetermined length in a longitudinal direction. Since the stub 200 is formed on a substrate (not shown) having a ground formed on the back thereof, the strip-like coil 100 is also disposed on the ground. As a result, the ground (not shown) is provided on one side of the strip-like coil 100 that is opposite (x-axis negative direction) to the coupling direction. One terminal C of the stub 200 is connected to the input/output line 300 and the other terminal D is short-circuited to the ground. Hence, when the electric field coupler 10 sends a signal by contactless communication, a radio-frequency signal is transmitted from the input/output line 300 connected to the terminal C. At this time, the stub 200 has a length at which resonance occurs at the frequency of the radio-frequency signal and thus resonates with the radio-frequency signal. Note that here the case is exemplified in which the stub 200 has an electrical length L ($=\frac{1}{2}\times\lambda$) that is one-half time of the wavelength of a radio-frequency signal. That is, the terminal D of the stub 200 is an open end for current and is a fixed end for voltage. Accordingly, taking look at the voltage at the stub 200 when resonating by a radio-frequency signal, the voltage forms a standing wave having a node at the terminal D and having an antinode at a middle connection point E between the terminals C and D. The stub 200 is connected to the terminal A which is one end of the strip-like coil 100, at a location corresponding to the antinode of the standing wave, i.e., the middle connection point E. In other words, a radio-frequency signal that resonates in the stub 200 is supplied to the strip-like coil 100, and by a voltage thereof a current flows through the strip-like coil 100. Meanwhile, as shown in FIG. 1, the length of the stub 200 is not limited to one that corresponds to one-half wavelength and can be any as long as the length is one at which resonance occurs by a radio-frequency signal; for example, the length may be one that corresponds to one-quarter wavelength or an integral multiple of one-quarter wavelength. In this case, too, the terminal A of the strip-like coil 100 is connected to the stub 200 at a location corresponding to an antinode of a standing wave of a resonating voltage. Note that when the electric field coupler 10 receives a signal by contactless communication, too, the received signal similarly resonates in the stub 200.

It is desirable that a radio-frequency signal to be used by the electric field coupler 10 according to the present embodiment use high frequencies such as UWB (Ultra-Wide Band) and a wide band of 500 MHz or higher. The length in the longitudinal direction of the stub 200 is set such that resonance occurs at such use frequencies. Note, however, that, in the electric field coupler 10 according to the present embodiment, the use frequencies are not limited thereto and the length of the stub 200, etc., can be adjusted appropriately according to a frequency band to be used. However, by using high frequencies and a wide band such as those described above, high-speed, high-capacity data communication can be achieved.

The input/output line 300 is, as described above, connected to the terminal C of the stub 200 and transmits a radio-frequency signal. Hence, to an end of the input/output line 300 that is opposite to the stub 200 is connected a transmit/receive circuit (not shown). A radio-frequency signal is outputted from the transmit/receive circuit or is inputted to the transmit/receive circuit.

The electric field coupler 10 having such strip-like coil 100, stub 200, and input/output line 300 may be mounted on, for example, as described above, a substrate (not shown) having a ground formed on the back (back side) thereof. Specifically, for example, an input/output line 300 and a stub 200 are stacked and formed on a front side (a plane in the x-axis positive direction) of a substrate having a ground formed on the backside (a plane in the x-axis negative direction) thereof. Holes (through-holes) are made in an insulating layer at locations corresponding to terminals D and B. The terminals D and B are short-circuited to the ground via the holes. Then, a strip-like coil 100 is disposed such that a terminal A and the terminal B are respectively connected to a connection point E of the stub 200 and the location corresponding to the short-circuited terminal B.

Next, the configuration, etc., of the strip-like coil 100 included in the electric field coupler 10 will be described in detail.

[1.2 Strip-like coil (electric field coupling electrode)]

Figure 2:
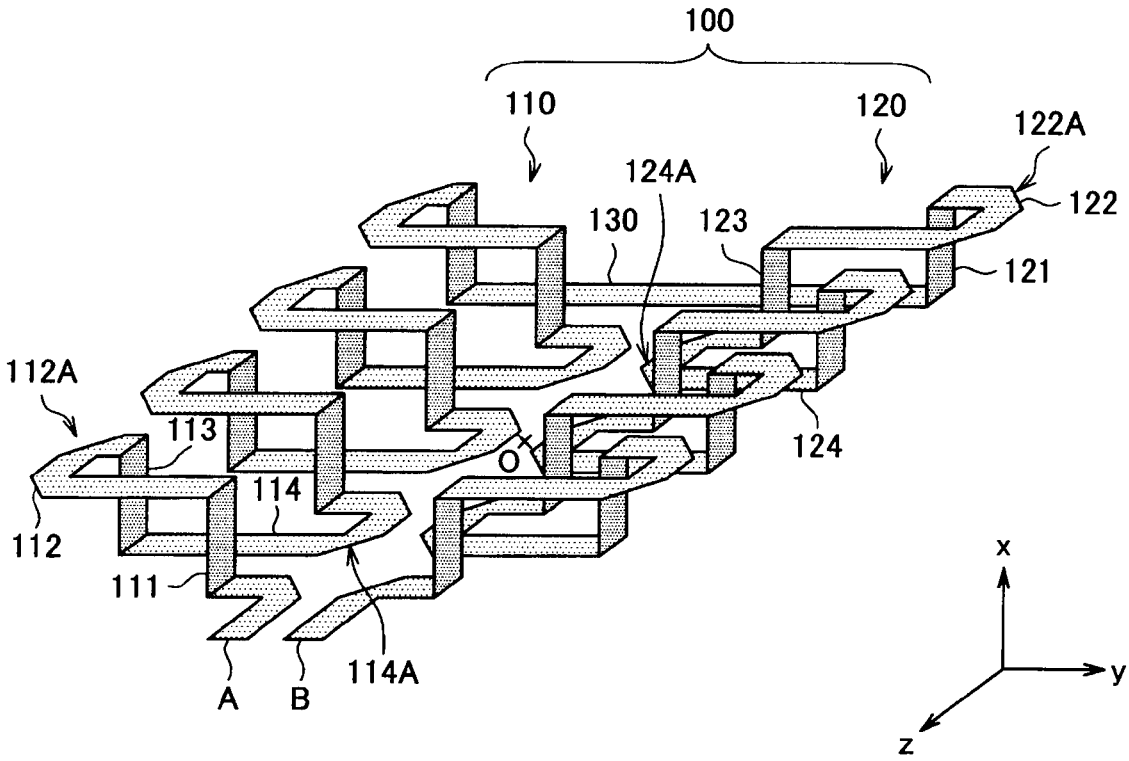
FIG. 2 is a perspective view of a strip-like coil included in the electric field coupler according to the first embodiment.
Figure 3A:
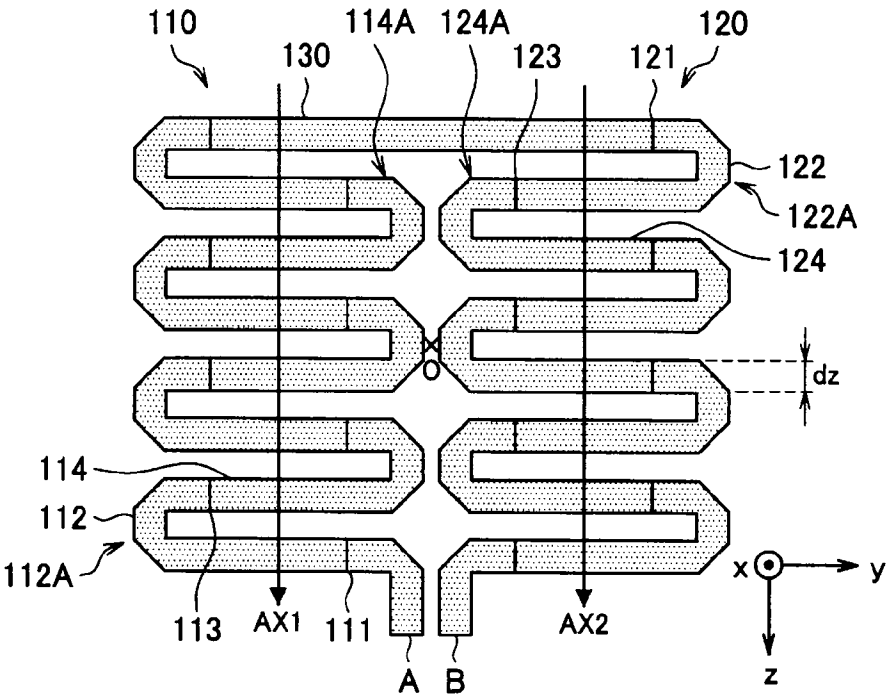
FIGS. 3A to 3C are a three-sided view diagram of the strip-like coil included in the electric field coupler according to the first embodiment.
Figure 3B:
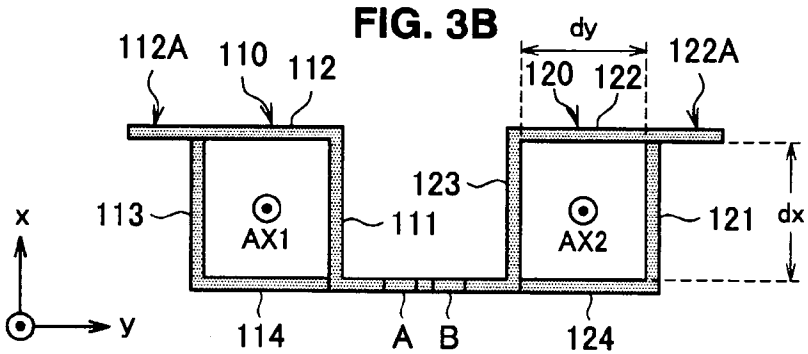
Figure 3C:
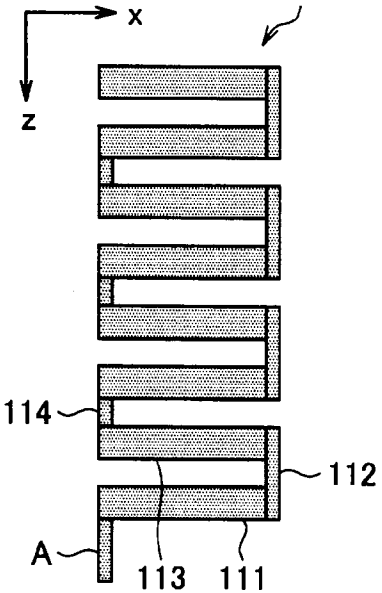
Figure 4:
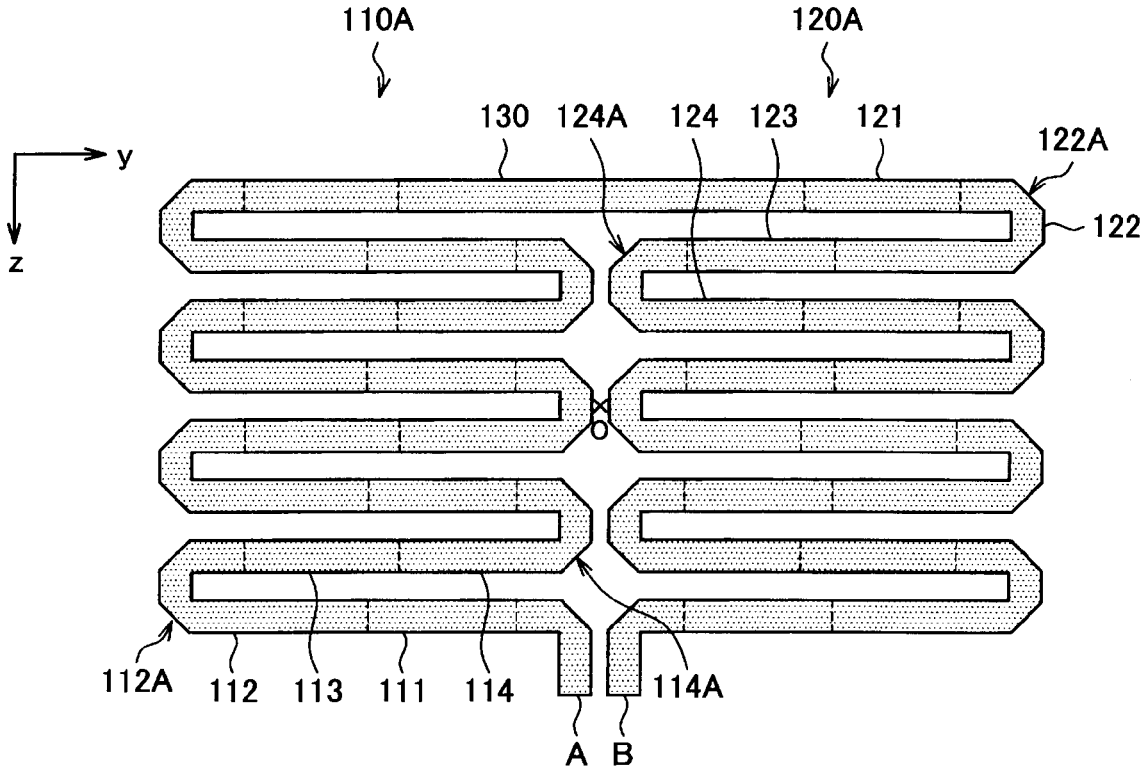
FIG. 4 is a development view of the strip-like coil included in the electric field coupler according to the first embodiment.

FIG. 2 is a perspective view of the strip-like coil 100 included in the electric field coupler 10 according to the present embodiment. FIGS. 3A to 3C are a three-sided view diagram of the strip-like coil 100 included in the electric field coupler 10 according to the present embodiment. FIG. 4 is a development view of the strip-like coil 100 included in the electric field coupler 10 according to the present embodiment. Note that FIG. 3A is a top view of the strip-like coil 100 (a view as seen from an x-axis positive direction), FIG. 3B is a front view of the strip-like coil 100 (a view as seen from a z-axis positive direction), and FIG. 3C is a side view of the strip-like coil 100 (a view as seen from a y-axis negative direction).

First, a summary of the configuration of the strip-like coil 100 will be described. As shown in FIG. 2, etc., the strip-like coil 100 is formed by bending a strip-like conductor (see FIG. 4) which snakes along a plane (yz plane) perpendicular to a coupling direction (x-axis direction), such that coil axes AX1 and AX2 are perpendicular to the coupling direction (x-axis direction). The strip-like coil 100 has a form in which the coil axes AX1 and AX2 surround a central portion O along the plane (yz plane). Furthermore, the strip-like coil 100 is formed to have an electrical length of one-half wavelength of the frequency of a radio-frequency signal.

A more specific description will be made.

The strip-like coil 100 roughly includes, between the terminal A connected to the stub 200 and the terminal B to be short-circuited, a first strip-like coil 110, a second strip-like coil 120, and a connecting portion 130. That is, considering a line of the strip-like coil 100 from the terminal A to the terminal B, the line passes through the first strip-like coil 110 from the terminal A and is connected to the connecting portion 130 at one end of the first strip-like coil 110 and the other end of the connecting portion 130 is connected to one end of the second strip-like coil 120. Then, the other end of the second strip-like coil 120 is connected to the terminal B.

The first strip-like coil 110 and the second strip-like coil 120 are examples of two strip-like coils. As shown in FIG. 3A, the first strip-like coil 110 and the second strip-like coil 120 are disposed side by side such that their respective coil axes AX1 and AX2 are parallel to each other. Then, the connecting portion 130 connects one end of the respective first and second strip-like coils 110 and 120. Hence, as shown in FIGS. 2 and 3A, the central portion O of the strip-like coil 100 is surrounded by the first strip-like coil 110, the second strip-like coil 120, and the connecting portion 130, in a formation plane (yz plane) of the strip-like coil 100.

In the present embodiment, the first strip-like coil 110, the second strip-like coil 120, and the connecting portion 130 are formed of a strip-like conductive material, as described above, and are formed to have a predetermined identical strip width, except some portions such as turning points. Note that the width is set by the strength, resistance value, etc., of the strip-like coil 100. Note also that the strip-like coil 100 may have a part where the strip width is extended, at a location other than turning points and such a strip-like coil will be described in third and fourth embodiments.

The lengths of the first strip-like coil 110, the second strip-like coil 120, and the connecting portion 130 are set to have an electrical length of one-half wavelength of the frequency of the above-described radio-frequency signal. The lengths vary depending on the resistance value, reactance value, etc., of the strip-like coil 100 and thus are appropriately set. By having such electrical lengths, when a radio-frequency signal is inputted through the stub 200, the radio-frequency signal resonates in the strip-like coil 100. As a result, alternating magnetic fluxes are generated in the first strip-like coil 110 and the second strip-like coil 120. By the alternating magnetic fluxes, a longitudinal wave electric field which vibrates in the coupling direction (x-axis direction) is generated at the central portion O of the strip-like coil 100.

The winding directions of the first strip-like coil 110 and the second strip-like coil 120 are reversed at the connecting portion 130 (an example of a connecting location). In other words, as described above, the strip-like coil 100 has an electrical length of one-half wavelength of a radio-frequency signal and the turning direction of the strip-like coil 100 is reversed at one-quarter wavelength location (middle location). Namely, as shown in FIG. 2, in the case of the example of the present embodiment, the winding direction of the first strip-like coil 110 is supposedly set to a direction in which a magnetic flux is generated in a positive direction of the coil axis AX1 at the moment at which a direct current passes from the terminal A to the terminal B. When the winding direction of the second strip-like coil 120 is not reversed, a magnetic flux is generated in a negative direction of the coil axis AX2; however, since the winding direction of the second strip-like coil 120 is reversed, the winding direction of the second strip-like coil 120 is set to a direction in which a magnetic flux is generated in a positive direction of the coil axis AX2. Note that when a radio-frequency signal is inputted to cause resonance in the strip-like coil 100, one of magnetic fluxes (also referred to in a pseudo manner as "magnetic currents" in contrast with currents) generated in the first strip-like coil 110 and the second strip-like coil 120 is reversed and thus the magnetic fluxes surround the central portion O. As a result, the strip-like coil 100 can enhance a longitudinal wave electric field to be generated at the central portion O, enabling to improve electrical characteristics and coupling characteristics. The way of winding a coil being reversed and resonance, etc., obtained at that time will be described in detail later together with effects, etc.

The configurations of the first strip-like coil 110 and the second strip-like coil 120 will be more specifically described. As shown in the development view of FIG. 4, the first strip-like coil 110 and the second strip-like coil 120 respectively have a snaking strip-like line 110A and a snaking strip-like line 120A. The strip-like lines 110A and the strip-like line 120A are connected to each other by a strip-like connecting portion 130. The first strip-like coil 110 is formed by bending the strip-like line 110A at dotted-line locations in FIG. 4 in the positive or negative direction of the coupling direction (x-axis). The second strip-like coil 120 is also formed by bending the strip-like line 120A at dotted-line locations in FIG. 4 in the positive or negative direction of the coupling direction (x-axis). Although here the case in which the bending angle is a right angle is shown, the bending angle may be curved. Note that a strip-like line having snaking lines such as the strip-like line 110A, the strip-like line 120A, and the connecting portion 130, as shown in FIG. 4, can also be fabricated by, for example, stamping a conductive plate (e.g., sheet metal). Furthermore, the strip-like line can also be formed by various methods such as etching and pouring a molten conductive material (e.g., a metallic material) into a predetermined mold. The formation and bending of the strip-like line will be described again in the following fabrication method.

The first strip-like coil 110 is one example of two strip-like coils. An inner rising portion 111, an outer turning portion 112, an outer rising portion 113, and an inner turning portion 114 are repeatedly formed, whereby a coil with the coil axis AX1 being the center is formed. Of them, the inner rising portions 111 and the outer rising portions 113 are formed parallel to the coupling direction (x-axis direction) by bending the strip-like line. The inner turning portions 114 are disposed on the substrate (not shown) and connect, on the substrate, their corresponding inner rising portions 111 and outer rising portions 113. The outer turning portions 112 connect their corresponding inner rising portions 111 and outer rising portions 113, on a plane (yz plane) that projects from the substrate in the coupling direction. At this time, each outer turning portion 112 has a first extending part which extends outwardly from an end of a corresponding inner rising portion 111; a second extending part which extends inwardly to an end of a corresponding outer rising portion 113; and an outer overhanging portion 112A which connects these parts. The first extending part is formed to be longer than the second extending part. Each inner turning portion 114 has a third extending part which extends inwardly from an end of a corresponding outer rising portion 113; a fourth extending part which extends outwardly to an end of a corresponding inner rising portion 111 of a next repetition unit; and an inner overhanging portion 114A which connects these parts. The third extending part is formed to be longer than the fourth extending part. Accordingly, as shown in FIG. 3B, the first strip-like coil 110 forms one coil plane (one winding) with the coil axis AX1 being the center, by an outer rising portion 113, an inner rising portion 111, a first extending part of an outer turning portion 112, and a third extending part of an inner turning portion 114. As shown in FIGS. 2 and 3A, by repeating this coil-plane unit, the first strip-like coil 110 is formed. Note that a part of the connecting portion 130 which connects the first strip-like coil 110 and the second strip-like coil 120, on the side of the first strip-like coil 110 also forms a part of one coil plane of the first strip-like coil 110. A line that forms a coil can be further extended by forming an inner rising portion 111 at the connecting portion 130. However, since by a repetition of a coil plane as shown in FIG. 2 a magnetic field with an appropriate intensity along the coil axis AX1 can be generated, without forming an inner rising portion 111 at the connecting portion 130, the first strip-like coil 110 can be formed. Note that in the case of a form in which an inner rising portion 111 is not formed at the connecting portion 130, such as that shown in FIG. 2, fabrication by the following fabrication method can be facilitated. Note also that the outer overhanging portions 112A of the first strip-like coil 110 are an example of an overhanging portion and are formed on a side of the first strip-like coil 110 to overhang in a direction (y-axis direction) perpendicular to the coupling direction (x-axis direction).

The second strip-like coil 120 is one example of two strip-like coils. An outer rising portion 121, an outer turning portion 122, an inner rising portion 123, and an inner turning portion 124 are repeatedly formed, whereby a coil with the coil axis AX2 being the center is formed. Of them, the outer rising portions 121 and the inner rising portions 123 are formed parallel to the coupling direction (x-axis direction) by bending the strip-like line. The inner turning portions 124 are disposed on the substrate (not shown) and connect, on the substrate, their corresponding outer rising portions 121 and inner rising portions 123. The outer turning portions 122 connect their corresponding outer rising portions 121 and inner rising portions 123, on a plane (yz plane) that projects from the substrate in the coupling direction. At this time, each outer turning portion 122 has a fifth extending part which extends outwardly from an end of a corresponding outer rising portion 121; a sixth extending part which extends inwardly to an end of a corresponding inner rising portion 123; and an outer overhanging portion 122A which connects these parts. The fifth extending part is formed to be longer than the sixth extending part. Each inner turning portion 124 has a seventh extending part which extends inwardly from an end of a corresponding inner rising portion 123; an eighth extending part which extends outwardly to an end of a corresponding outer rising portion 121 of a next repetition unit; and an inner overhanging portion 124A which connects these parts. The third extending part is formed to be longer than the fourth extending part. Accordingly, as shown in FIG. 3B, the second strip-like coil 120 forms one coil plane (one winding) with the coil axis AX2 being the center, by an outer rising portion 121, an inner rising portion 123, a fifth extending part of an outer turning portion 122, and a seventh extending part of an inner turning portion 124. As shown in FIGS. 2 and 3A, by repeating this coil-plane unit, the second strip-like coil 120 is formed. Note that, as in the case of the first strip-like coil 110, a part of the connecting portion 130 which connects the first strip-like coil 110 and the second strip-like coil 120, on the side of the second strip-like coil 120 also forms a part of one coil plane of the second strip-like coil 120. Although a line that forms a coil can be further extended by forming an inner rising portion 123 at the connecting portion 130, such an inner rising portion 123 at the connecting portion 130 is not necessarily needed, as with the first strip-like coil 110. In the case in which an inner rising portion 123 is not provided to the connecting portion 130, fabrication by the following fabrication method can be facilitated.

Note that the outer overhanging portions 112A of the first strip-like coil 110 are an example of an overhanging portion and are formed on a side of the first strip-like coil 110 to overhang in a direction (y-axis direction) perpendicular to the coupling direction (x-axis direction). The outer overhanging portions 122A of the second strip-like coil 120 are also an example of an overhanging portion and are formed on a side of the second strip-like coil 120 to overhang in a direction (y-axis direction) perpendicular to the coupling direction (x-axis direction). Such outer overhanging portions 112A and 122A can be grasped when, upon fabricating an electric field coupler 10, the strip-like coil 100 is formed by bending or when handling upon assembling. Accordingly, since the strip-like coil 100 can be fixed or moved by the outer overhanging portions 112A and 122A, fabrication can be facilitated. In the above description, the term "inner" indicates a direction coming close to the central portion O in the first strip-like coil 110 or the second strip-like coil 120 when seeing the y-axis direction, as shown in FIG. 3A, for example, and the term "outer" indicates, in contrast thereto, a direction going away from the central portion O.

The configuration of the electric field coupler 10 according to the present embodiment has been described above.

Next, a fabrication method for an electric field coupler 10 according to the present embodiment will be described with reference to FIGS. 4 and 5.

[1.3 Fabrication method for an electric field coupler]

Figure 5:
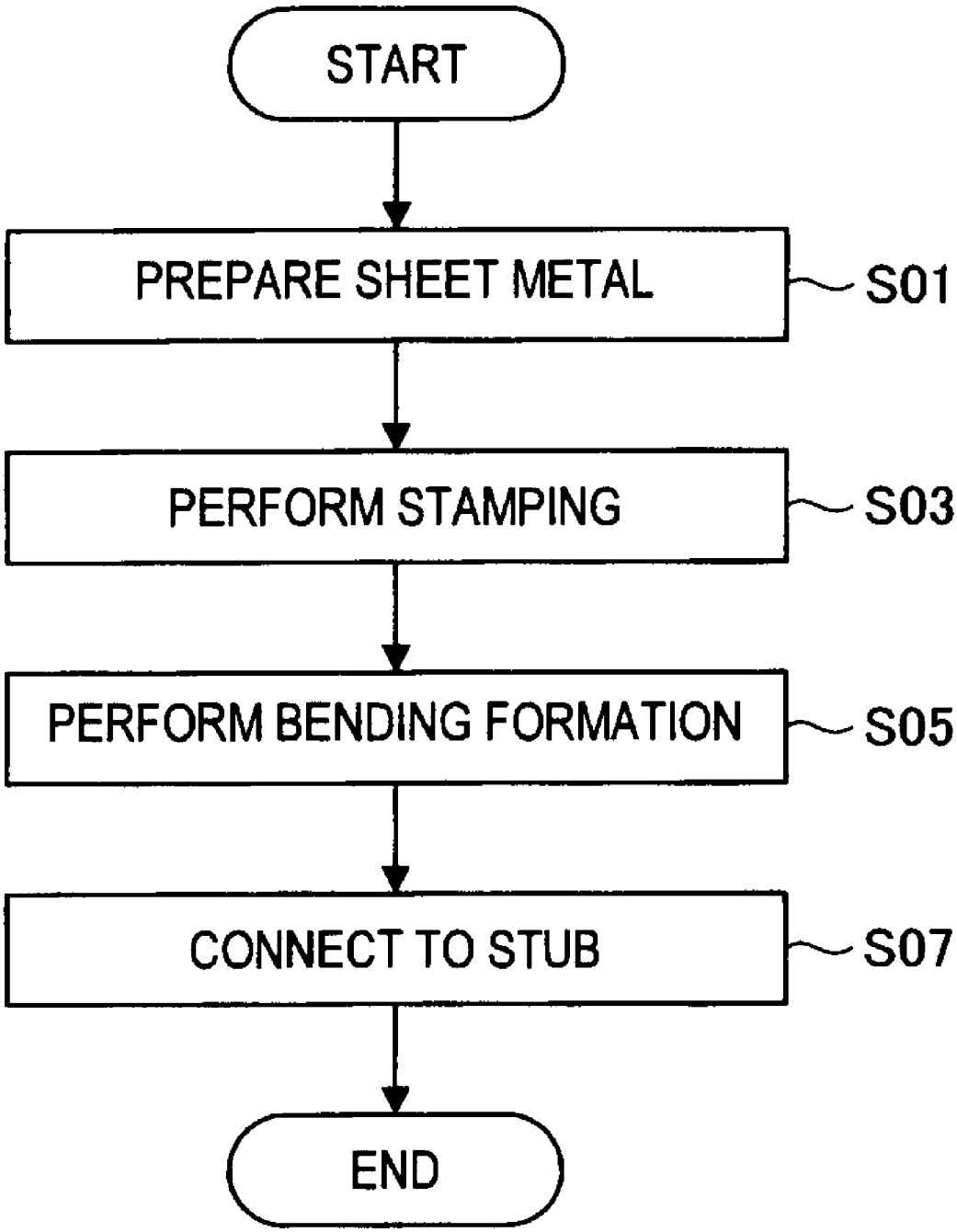
FIG. 5 is an illustrative diagram describing a fabrication method for an electric field coupler according to the first embodiment.

FIG. 5 is an illustrative diagram describing a fabrication method for an electric field coupler 10 according to the present embodiment.

First, step S01 in FIG. 5 is processed where one plate-like conductive material (e.g., sheet metal; in the following, description is made using sheet metal) is prepared.

Then, step S03 is processed where the sheet metal prepared at step S01 is stamped to form a line of a strip-like conductor that has a snaking strip-like line 110A, a snaking strip-like line 120A, and a connecting portion 130 that connects the strip-like lines 110A and 120A, such as those shown in FIG. 4 (stamping step).

Thereafter, step S05 is processed where the strip-like conductor formed at step S03 by a predetermined die, a jig, etc., is bent at dotted-line locations shown in FIG. 4 in the positive or negative direction of the coupling direction (x-axis) to form a strip-like coil 100 (forming step). Note that the strip-like coil 100 formed at step S05 has, as described above, two strip-like coils (a first strip-like coil 110 and a second strip-like coil 120). Coil axes AX1 and AX2 of the two strip-like coils are perpendicular to the coupling direction (x-axis direction) and are parallel to each other in a plane (yz plane) perpendicular to the coupling direction and thus surround a central portion O of the strip-like coil 100. After the process at step S05, step S07 is processed.

At step S07, the strip-like coil 100 formed at step S05 is disposed on a substrate (not shown) and a terminal A thereof is connected to a stub 200 and then a terminal B thereof is short-circuited. As a result, an electric field coupler 10 such as that shown in FIG. 1 is formed.

Note that here the case is described in which by processing steps S01 and S03 a line of a strip-like conductor such as that shown in FIG. 4 is formed. However, a line forming method according to an embodiment of the present invention is not limited thereto. For example, a line can be formed by pouring a conductive material into a mold for forming a line such as that shown in FIG. 4. However, when a line is formed by stamping sheet metal, as shown at steps S01 and S03, processing is easy and a dedicated mold does not need to be formed and thus fabrication time and effort and cost can be reduced.

[1.4 Examples of the operation and effects of the electric field coupler]

The electric field coupler 10 according to the first embodiment of the present invention has been described above. Such an electric field coupler 10 can be regarded as a coil 400 in which two strip-like coils (a first strip-like coil 110 and a second strip-like coil 120) which surround a central portion O are formed in a pseudo manner by a linear conductor, such as that shown in FIG. 6, and which has a form in which coil axes surround the central portion O in a doughnut-like fashion. Hence, using the doughnut-shaped coil 400 shown in FIG. 6 as an example, a process of electric field generation by the electric field coupler 10 will be described.

As described above, the strip-like coil 100 (coil 400) has an electrical length of one-half of the wavelength of a radio-frequency signal. Hence, when a radio-frequency signal is inputted from the stub 200, the strip-like coil 100 resonates and thus a standing wave is established. As a result, an alternating magnetic flux that rotates around the central portion O is generated. The alternating magnetic flux generates, at the central portion O and the proximity thereof, a longitudinal wave electric field that travels in a coupling direction (x-axis direction) and vibrates in the coupling direction. Accordingly, the electric field coupler 10 can perform, by the longitudinal wave electric field, short-range contactless communication with an electric field coupler (which may be an electric field coupler 10 or another coupler having a plate electrode, etc.) included in another communication apparatus.

Figure 6:
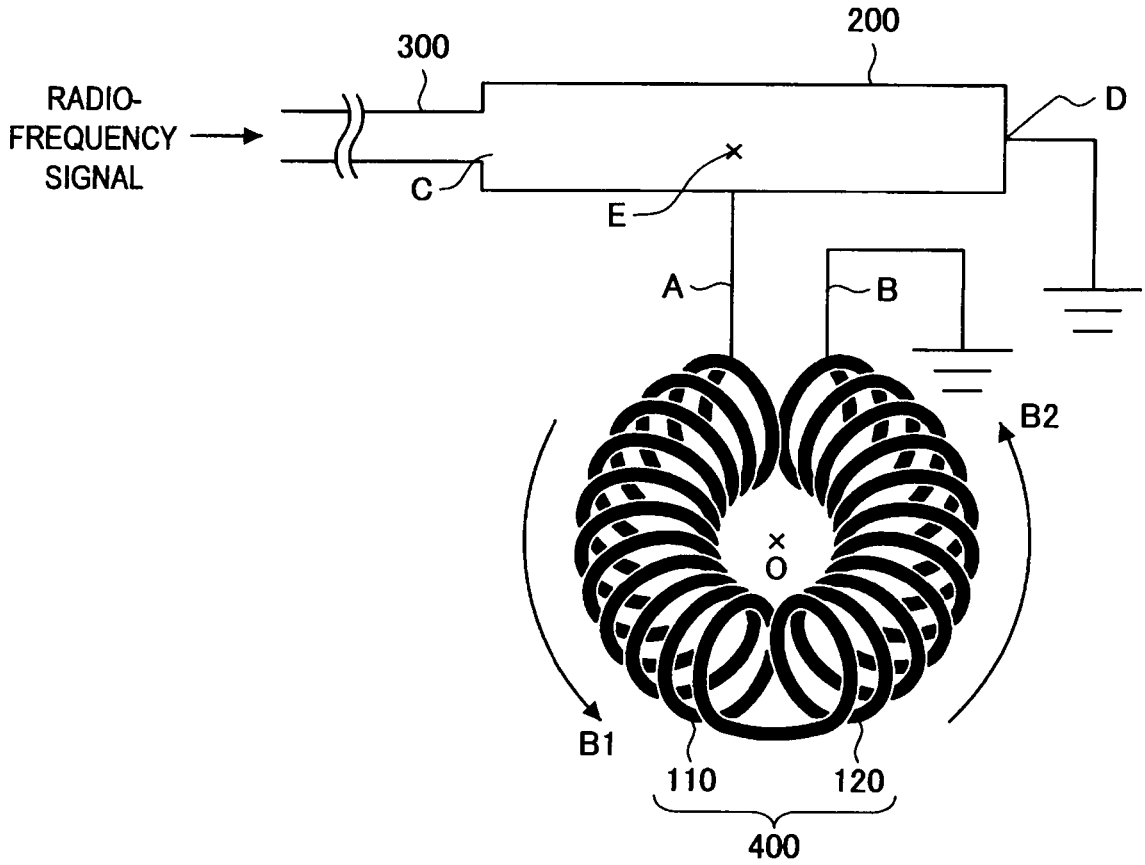
FIG. 6 is an illustrative diagram describing the operation, etc., of an electric field coupler according to the first embodiment.
Figure 7:
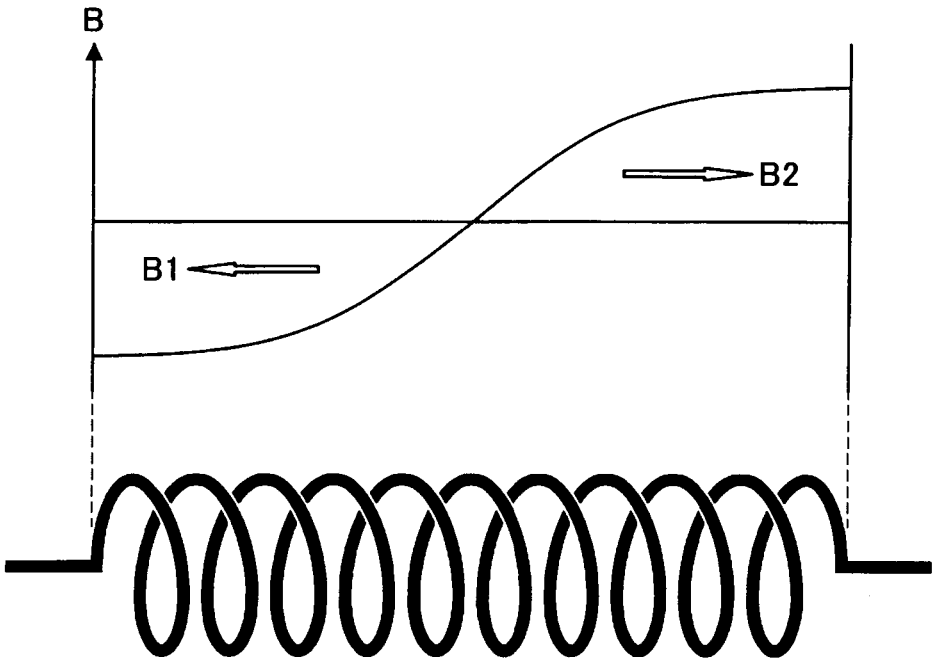
FIG. 7 is an illustrative diagram describing magnetic fluxes generated by the electric field coupler according to the first embodiment.
Figure 8:
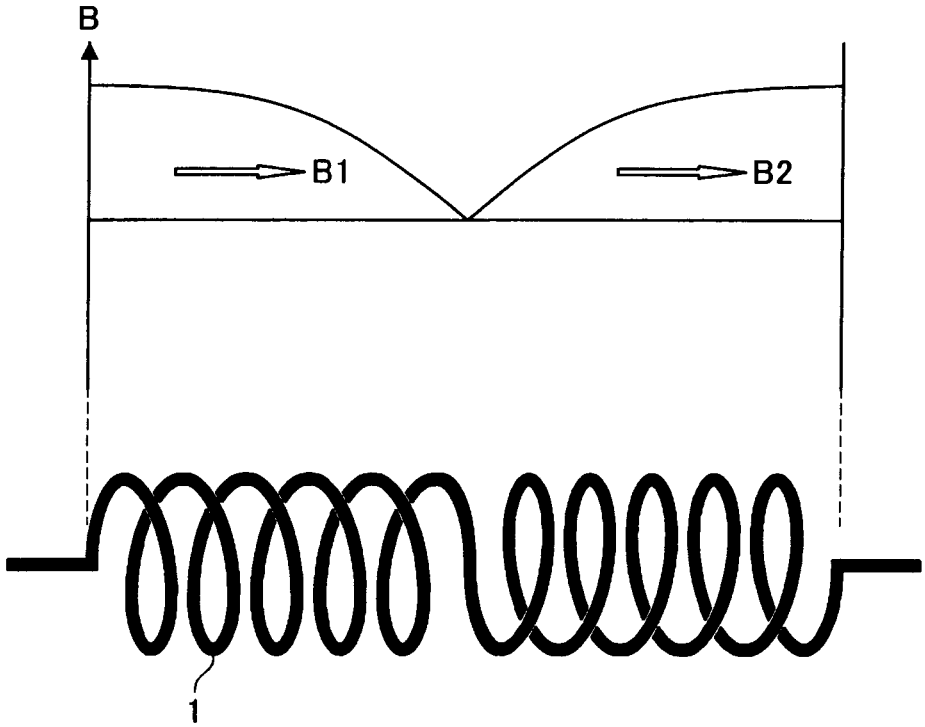
FIG. 8 is an illustrative diagram describing magnetic fluxes generated by the electric field coupler according to the first embodiment.

As described above, the first strip-like coil 110 and the second strip-like coil 120 of the strip-like coil 100 (coil 400) have reversed turning directions (winding directions). In this case, an electric field to be generated at the central portion O and the proximity thereof can be enhanced and thus electrical characteristics can be improved. A more specific description will be made below. As described above, when a radio-frequency signal is inputted, the strip-like coil 100 resonates. Assuming that the strip-like coil 100 is a coil having linear coil axes and has an electrical length of one-half wavelength and uniform turning directions, magnetic fluxes such as those shown in FIG. 7 are generated. On the other hand, when the turning directions are reversed, as in the present embodiment, magnetic fluxes such as those shown in FIG. 8 are generated. That is, since an end of each of the coils (i.e., the strip-like coils 100, etc.) shown in FIGS. 7 and 8 is an open end for current, the current change at the end is great and therefore a magnetic flux at the end is also large. Since the coils have an electrical length of one-half wavelength, a standing wave with one-half wavelength is established in the coils. At this time, when the turning directions are uniform, as shown in FIG. 7, magnetic fluxes whose directions oppose each other at a central portion of the coil are generated. The magnetic fluxes generate electric fields in opposite directions. Accordingly, when the coil is formed in a doughnut shape, as shown in FIG. 6, an electric field generated at the central portion O has an intensity at which communication can be performed to some extent but the intensity is low. On the other hand, when the turning directions are reversed, as shown in FIG. 8, magnetic fluxes (magnetic fluxes B1 and B2 or vice versa) whose directions are identical over a central portion of the coil are generated. The magnetic fluxes generate electric fields in the same direction. Accordingly, when the coil is formed in a doughnut shape, as shown in FIG. 6, the intensity of an electric field generated at the central portion O is increased. Hence, the coupling intensity of electric field coupling can be increased and thus electrical characteristics can be improved over the case shown in FIG. 7.

The strip-like coil 100 according to the present embodiment is formed by, as described above, stamping sheet metal, for example, into a snaking strip-like conductor and then bending the strip-like conductor. Thus, easy fabrication can be achieved. On the other hand, for a normal coil 400 formed by winding around a linear conductor, the winding around of a coil is difficult and also takes time and thus fabrication is difficult. Furthermore, to form the coil 400, a coil needs to be formed in a doughnut shape to surround the central portion O but forming a coil in such a doughnut shape is not easy. Also, in such a coil, it is very difficult to keep the areas of coil cross sections uniform and keep the pitch spacings between windings of the coil uniform. Hence, variations in the form of a coil become large and fabrication error becomes large and accordingly, for example, the resonance frequency deviates from a desired value and thus it is difficult to generate a stable magnetic flux. Furthermore, in the case of a normal coil, since the coil cross section is circular, the thickness of the coil 400 is equal to the length of a diameter and thus it is difficult to achieve slimming down. In view of this, making the coil cross section elliptical is considered but forming an elliptical coil makes fabrication more difficult. In contrast to such a coil 400, the strip-like coil 100 according to the present embodiment can be formed by an easy and accurate process such as stamping and bending, and coil cross sections can be formed uniformly by adjusting a distance dx and a distance dy shown in FIG. 3B. Furthermore, in the strip-like coil 100, pitch spacings can be similarly formed uniformly by adjusting a distance dz shown in FIG. 3A. Thus, according to the strip-like coil 100, not only is fabrication facilitated but also fabrication error is reduced and a resonance frequency having a desired value can be achieved, enabling to stably generate a magnetic field. Thus, according to the strip-like coil 100 fabricated in the present embodiment, electrical characteristics can be further improved.

Also, at this time, by reducing the distance dx shown in FIG. 3B, the thickness of the strip-like coil 100 can be reduced, which can also contribute to miniaturization of the entire apparatus. Furthermore, the strip-like coil 100 can be formed from one piece of sheet metal, as shown in FIG. 4, and the strip-like coil 100 according to the present embodiment has a simple development view, as shown in FIG. 4, and a small area. Accordingly, the area of sheet metal to be stamped can be reduced. Note that in the case of the strip-like coil 100, over the case of using a plate-like electric field coupling electrode, independently of the area thereof a large electric field can be stably generated; therefore, needless to say, the area in a plane (yz plane) perpendicular to the coupling direction (x-axis direction) can be reduced. In the strip-like coil 100, a ground is formed in a direction opposite to the coupling direction. The ground can prevent an electric field from radiating in the direction opposite to the coupling direction. Note that when a normal plate-like electrode is used to produce electric field coupling, if the distance between the electrode and the ground is small, the intensity of an electric field generated in the coupling direction is reduced. Hence, with such a plate-like electrode, it is difficult to reduce the profile by reducing the thickness of the entire apparatus. However, in the case of the strip-like coil 100 according to the present embodiment, alternating magnetic fields generated along the coil axes AX1 and AX2 are not likely to be affected even when the distance between the strip-like coil 100 and the ground is small and thus a reduction in the intensity of an electric field generated in the coupling direction by the strip-like coil 100 does not occur. Hence, the electric field coupler 10 can be formed to be small in profile and compact.

The electric field coupler 10 according to the first embodiment of the present invention has been described above. Next, electric field couplers according to second to fourth embodiments of the present invention which are modified examples of the electric field coupler 10 will be described one by one. Note that although the electric field couplers according to the second to fourth embodiments are different from the electric field coupler 10 according to the first embodiment in a part of the configuration of a strip-like coil, the rest of the configuration is formed in the same manner as in the first embodiment. Hence, in the following, strip-like coils included in the respective electric field couplers according to the embodiments will be described and differences between the strip-like coils and the strip-like coil 100 will be described.

<2. Second Embodiment>

Figure 9:
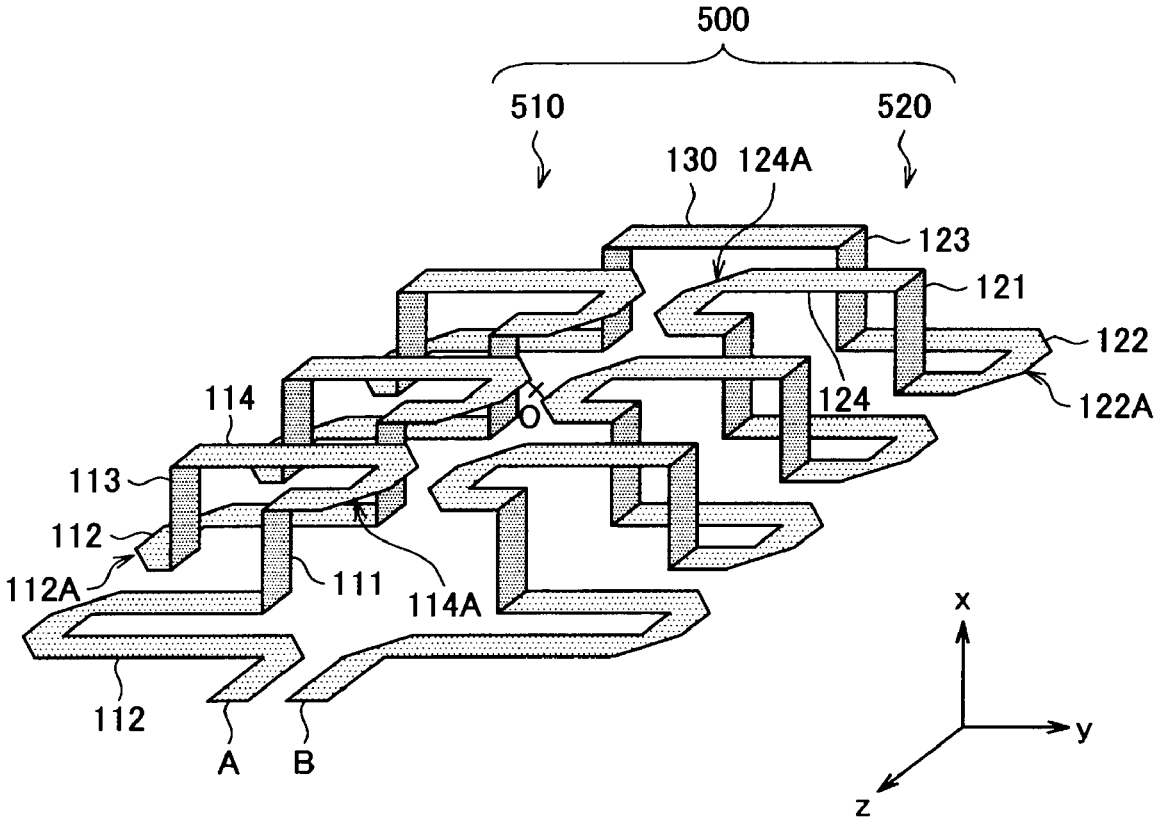
FIG. 9 is a perspective view of a strip-like coil included in an electric field coupler according to a second embodiment of the present invention.
Figure 10A:
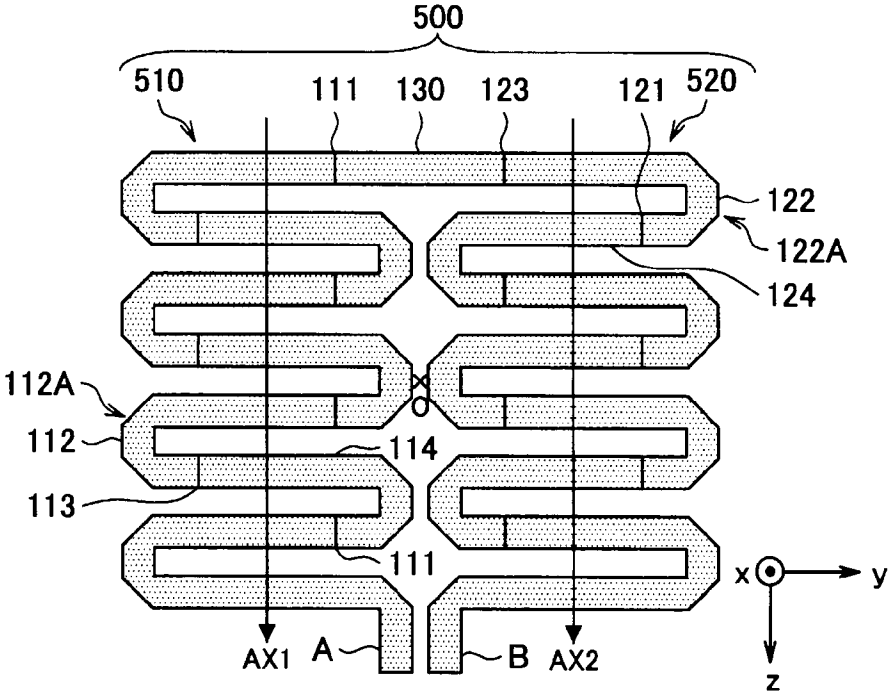
FIGS. 10A to 10C are a three-sided view diagram of the strip-like coil included in the electric field coupler according to the second embodiment.
Figure 10B:
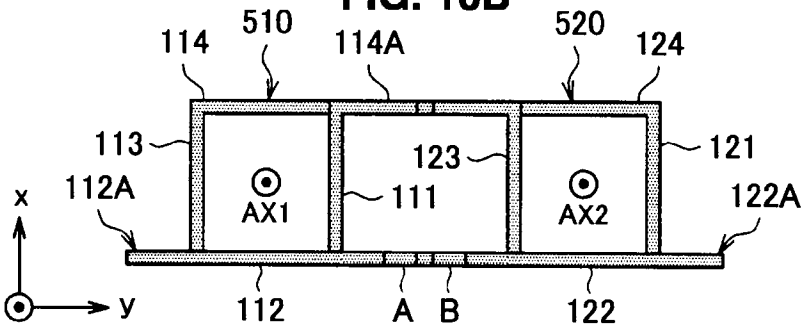
Figure 10C:
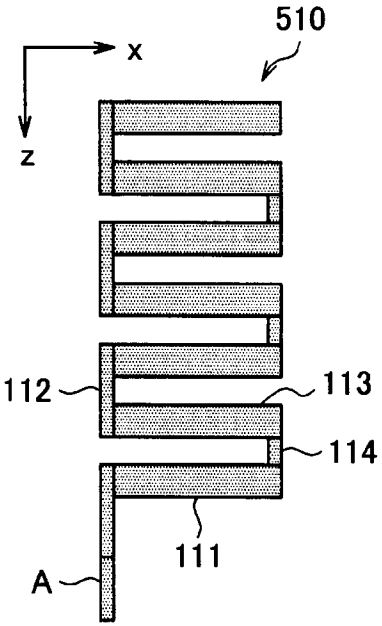

FIG. 9 is a perspective view of a strip-like coil 500 included in an electric field coupler according to the present embodiment. FIGS. 10A to 10C are a three-sided view diagram of the strip-like coil 500 included in the electric field coupler according to the present embodiment. Note that FIG. 10A is a top view of the strip-like coil 500 (a view as seen from an x-axis positive direction), FIG. 10B is a front view of the strip-like coil 500 (a view as seen from a z-axis positive direction), and FIG. 10C is a side view of the strip-like coil 500 (a view as seen from a y-axis negative direction).

As shown in FIGS. 9, 10A, and 10B, the strip-like coil 500 according to the present embodiment is formed basically in the same manner as the strip-like coil 100. Specifically, the strip-like coil 500 includes a first strip-like coil 510 corresponding to the first strip like coil 110; a second strip-like coil 520 corresponding to the second strip-like coil 120; and a connecting portion 130.

In the first strip-like coil 110 and the second strip-like coil 120 according to the first embodiment, as shown in FIG. 2, the outer turning portions 112 and 122 which are away from the central portion O project forwardly in the coupling direction (x-axis positive direction). The inner turning portions 114 and 124 close to the central portion O are placed on the substrate (not shown). On the other hand, as shown in FIGS. 9, 10A, and 10B, in the first strip-like coil 510 and the second strip-like coil 520 according to the present embodiment, inner turning portions 114 and 124 close to a central portion O project forwardly in a coupling direction (x-axis positive direction). Outer turning portions 112 and 122 which are away from the central portion O are placed on a substrate (not shown). Hence, outer overhanging portions 112A and 122A are placed on the substrate and thus those parts that project forwardly in the coupling direction do not have parts that overhang in a direction (y-axis direction) perpendicular to the coupling direction. Accordingly, the strength of the strip-like coil 500 can be increased.

<3. Third Embodiment>

Next, a strip-like coil 600 included in an electric field coupler according to a third embodiment of the present invention will be described with reference to FIGS. 11 and 12A to 12C.

Figure 11:
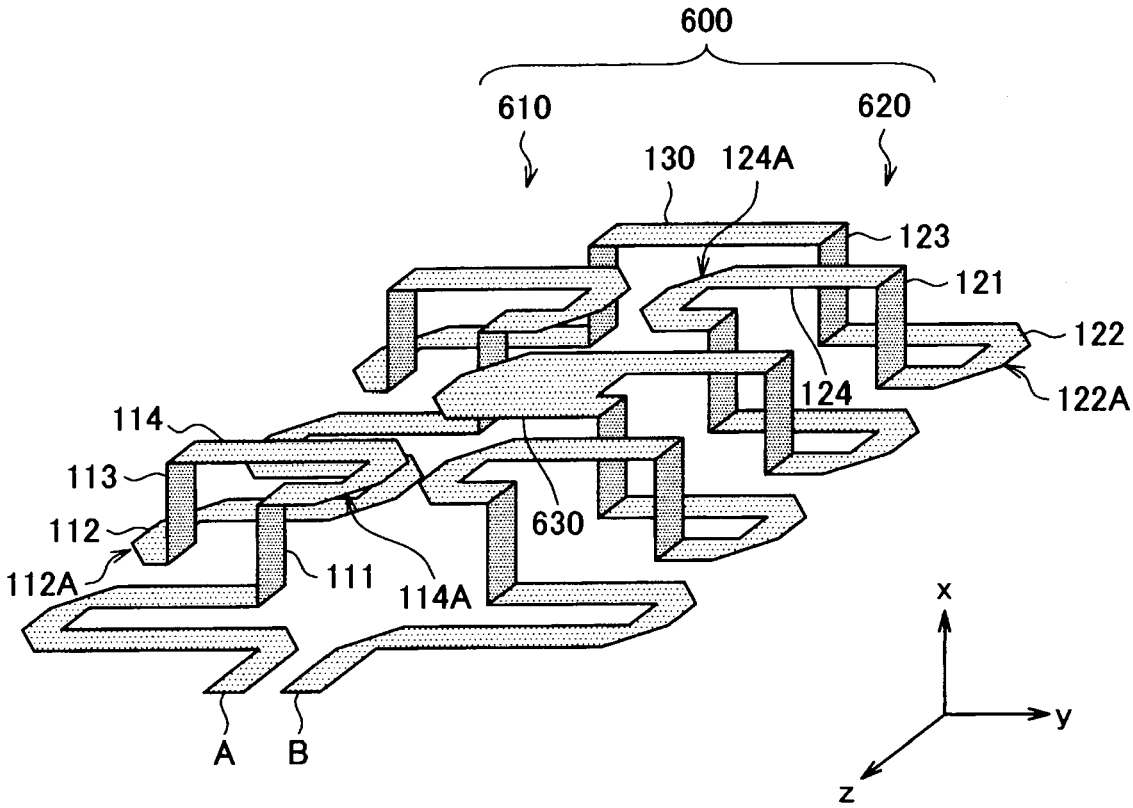
FIG. 11 is a perspective view of a strip-like coil included in an electric field coupler according to a third embodiment of the present invention.
Figure 12A:
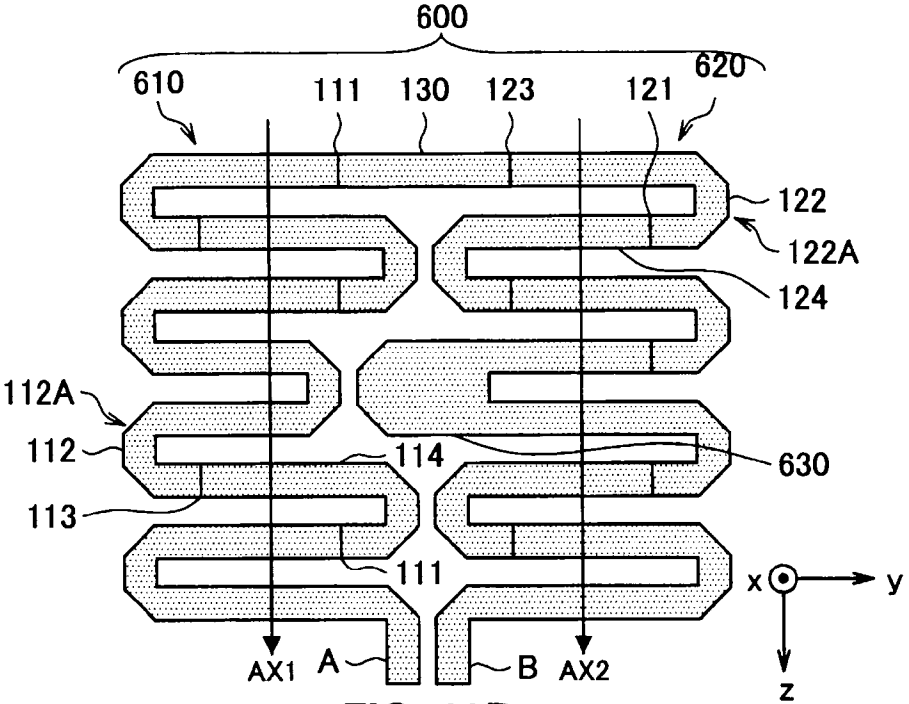
FIGS. 12A to 12C are a three-sided view diagram of the strip-like coil included in the electric field coupler according to the third embodiment.
Figure 12B:
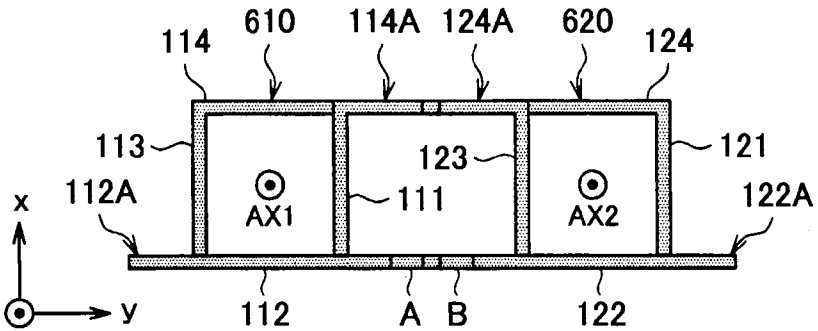
Figure 12C:
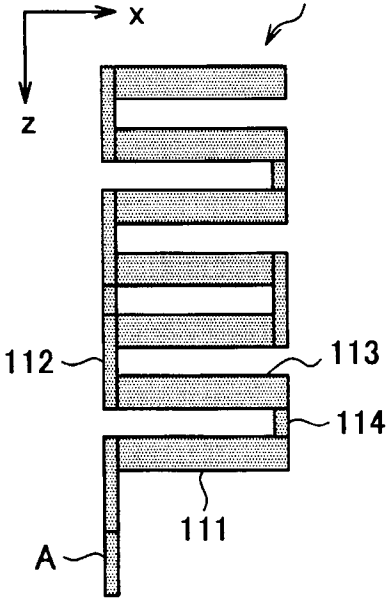

FIG. 11 is a perspective view of the strip-like coil 600 included in an electric field coupler according to the present embodiment. FIGS. 12A to 12C are a three-sided view diagram of the strip-like coil 600 included in the electric field coupler according to the present embodiment. Note that FIG. 12A is a top view of the strip-like coil 600 (a view as seen from an x-axis positive direction), FIG. 12B is a front view of the strip-like coil 600 (a view as seen from a z-axis positive direction), and FIG. 12C is a side view of the strip-like coil 600 (a view as seen from a y-axis negative direction).

As shown in FIGS. 11, 12A, and 12B, the strip-like coil 600 according to the present embodiment is formed basically in the same manner as the strip-like coil 500 according to the second embodiment. Specifically, the strip-like coil 600 includes a first strip-like coil 610 corresponding to the first strip-like coil 510; a second strip-like coil 620 corresponding to the second strip-like coil 520; and a connecting portion 130.

At this time, a part of the strip-like coil 600 (in the present embodiment, a part of one inner turning portion 124 of the second strip-like coil 620) has a suction point 630 where the strip width of a strip-like conductor is extended.

It is desirable that in the suction point 630 the strip width be extended to include, for example, the center of gravity (e.g., a central portion O) of the strip-like coil 600 in a plane (yz plane) perpendicular to a coupling direction (x-axis direction). The suction point 630 is formed so that the suction point 630 can be sucked by a suction nozzle of a mounter, etc., upon fabricating the strip-like coil 600. Hence, for example, upon handling or mounting the strip-like coil 600, the suction nozzle of the mounter can suck the suction point 630 and thus the strip-like coil 600 can be handled. According to such a configuration, the strip-like coil 600 can be automatically mounted on a substrate (not shown) by the mounter, enabling easy fabrication. Also, at this time, since, as described above, the suction point 630 is formed at the center of the gravity of the strip-like coil 600, the mounter can support the strip-like coil 600 without tilting the strip-like coil 600 and thus fabrication can be further facilitated.

<4. Fourth Embodiment>

Finally, a strip-like coil 700 included in an electric field coupler according to a fourth embodiment of the present invention will be described with reference to FIGS. 13 and 14A to 14C.

Figure 13:
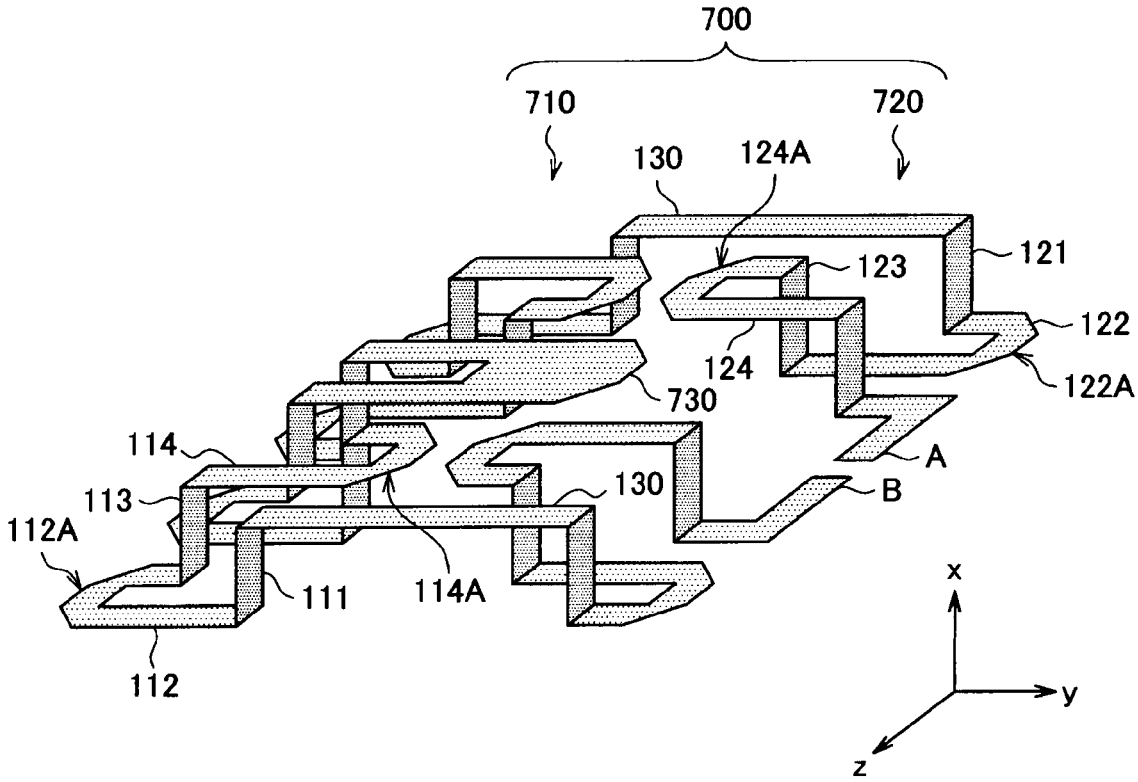
FIG. 13 is a perspective view of a strip-like coil included in an electric field coupler according to a fourth embodiment of the present invention.
Figure 14A:
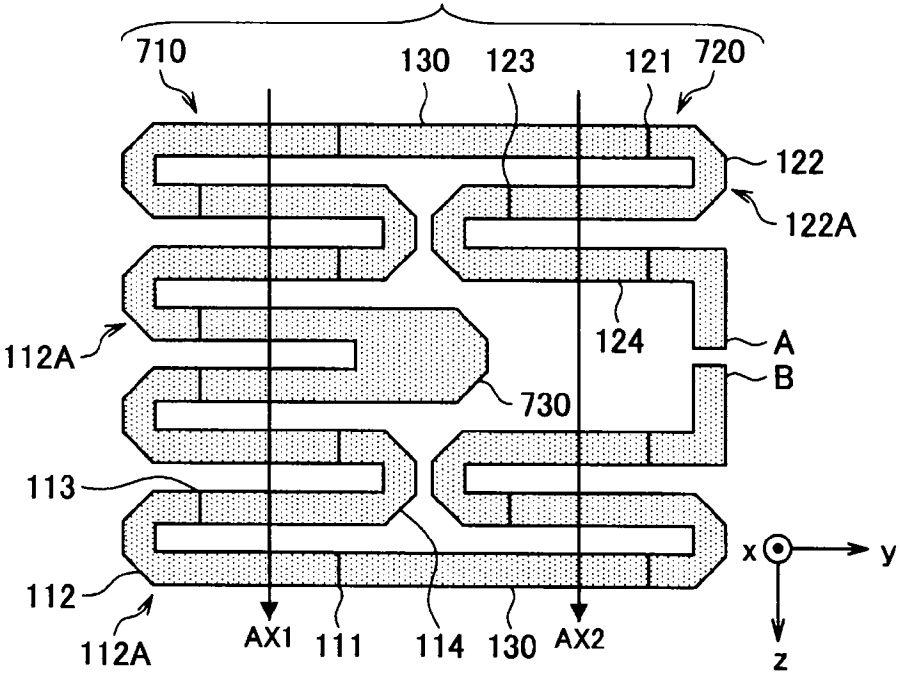
FIGS. 14A to 14C are a three-sided view diagram of the strip-like coil included in the electric field coupler according to the fourth embodiment.
Figure 14B:
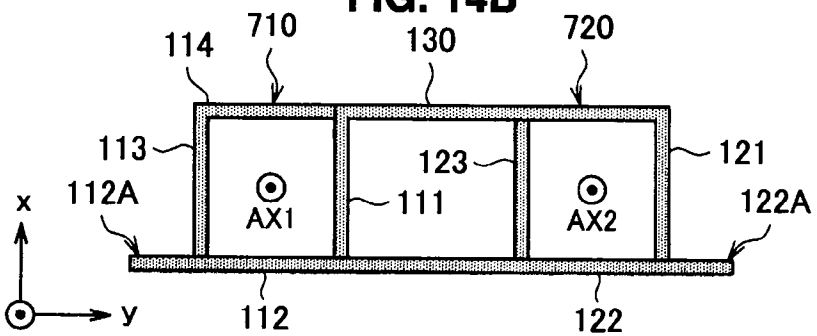
Figure 14C:
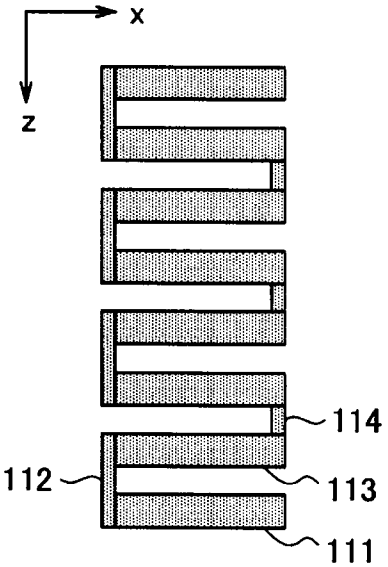

FIG. 13 is a perspective view of the strip-like coil 700 included in an electric field coupler according to the present embodiment. FIGS. 14A to 14C are a three-sided view diagram of the strip-like coil 700 included in the electric field coupler according to the present embodiment. Note that FIG. 14A is a top view of the strip-like coil 700 (a view as seen from an x-axis positive direction), FIG. 14B is a front view of the strip-like coil 700 (a view as seen from a z-axis positive direction), and FIG. 14C is a side view of the strip-like coil 700 (a view as seen from a y-axis negative direction).

As shown in FIGS. 13, 14A, and 14B, the strip-like coil 700 according to the present embodiment is formed basically in the same manner as the strip-like coil 600 according to the third embodiment. Specifically, the strip-like coil 700 includes a first strip-like coil 710 corresponding to the first strip-like coil 610; a second strip-like coil 720 corresponding to the second strip-like coil 620; and connecting portions 130.

Note, however, that the present embodiment is different from the third embodiment in that a suction point 730 corresponding to the suction point 630 is formed at a central location of the length of a strip-like conductor of the strip-like coil 700. Due to this, as shown in FIG. 14A, terminals A and B are provided at a central location of the second strip-like coil 720 and the two connecting portions 130 in total, one each at two ends of the respective first and second strip-like coils 710 and 720, are disposed. The suction point 730 is formed at an inner turning portion 114 of the first strip-like coil 710 that faces the terminals A and B.

By having such a configuration, in the strip-like coil 700 according to the present embodiment, the suction point 730 can be formed at a more precise center of gravity and thus fabrication can be further facilitated. Also, since the suction point 730 is formed at a middle point of the length of a strip-like conductor, the resistance values of portions of the strip-like conductor around the suction point 730 can be made uniform, enabling to stabilize a current flowing through the strip-like coil 700.

The present application contains subject matter related to that disclosed in Japanese Priority Patent Application JP 2008-193930 filed in the Japan Patent Office on Jul. 28, 2008, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

Although suction points are described in the third and fourth embodiments, the present invention is not limited thereto and a suction point can be formed at various locations. For example, the connecting portions 130 of the strip-like coils 100 and 500 described in FIGS. 2 and 9 may be extended to the central portion O and a suction point may be formed at the central portion O.

Although the first to fourth embodiments describe the case in which a coil is not formed at a connecting portion 130 of a strip-like coil, the present invention is not limited thereto. In order that a coil is also formed at a connecting portion 130, the connecting portion 130 may be formed in the same manner as a first strip-like coil or a second strip-like coil. Note, however, that in the case of strip-like coils according to the first to fourth embodiments, comparing with the case of forming a coil at a connecting portion 130, the development view thereof is simple, as shown in FIG. 4, and the area thereof is small. Thus, according to the strip-like coils according to the first to fourth embodiments, a plate material to be stamped is sufficient with a small area and the plate material can be easily stamped.

What is claimed is:

1. An electric field coupler comprising:

a strip-like coil formed by bending a strip-like conductor which snakes along a plane perpendicular to a coupling direction in which electric field coupling occurs, such that coil axes are perpendicular to the coupling direction, the strip-like coil having an electrical length of one-half wavelength of a predetermined frequency of a radio-frequency signal and having a form in which the coil axes surround a central portion along the plane, a resonance portion that resonates with a radio-frequency signal having the predetermined frequency which is supplied from a feed end and that is connected to one end of the strip-like coil at a location corresponding to an anti-node of a standing wave of a voltage by the resonance; and a ground provided on one side of the strip-like coil that is opposite to the coupling direction, wherein an other end of the strip-like coil is grounded, the strip-like coil produces coupling by a longitudinal wave electric field which vibrates in the coupling direction at the central portion, and a winding direction of the strip-like coil is reversed at the middle of the strip-like coil.

2. The electric field coupler according to claim 1, wherein a suction point where a strip width is extended is formed at a part of the strip-like coil so that a mounter can suck the suction point upon fabrication.

3. The electric field coupler according to claim 2, wherein the suction point is formed at a center of gravity of the strip-like coil in the plane perpendicular to the coupling direction.

4. The electric field coupler according to claim 1, wherein the strip-like coil has, on a side of the coil, an overhanging portion that overhangs in a direction perpendicular to the coupling direction.

5. A communication apparatus comprising:

a strip-like coil formed by bending a strip-like conductor which snakes along a plane perpendicular to a coupling direction in which electric field coupling occurs, such that coil axes are perpendicular to the coupling direction, the strip-like coil having an effective length of one-half wavelength of a predetermined frequency of a radio-frequency signal and having a form in which the coil axes surround a central portion along the plane, a resonance portion that resonates with a radio-frequency signal having the predetermined frequency which is supplied from a feed end and that is connected to one end of the strip-like coil at a location corresponding to an anti-node of a standing wave of a voltage by the resonance; and a ground provided on one side of the strip-like coil that is opposite to the coupling direction, wherein an other end of the strip-like coil is grounded, the strip-like coil performs contactless communication by producing coupling by a longitudinal wave electric field which vibrates in the coupling direction at the central portion, and a winding direction of the strip-like coil is reversed at the middle of the strip-like coil.

6. A communication system comprising:

two communication apparatuses that perform contactless communication by producing electric field coupling, wherein at least one of the two communication apparatuses has a strip-like coil formed by bending a strip-like conductor which snakes along a plane perpendicular to a coupling direction in which the electric field coupling occurs, such that coil axes are perpendicular to the coupling direction, the strip-like coil having an electrical length of one-half wavelength of a predetermined frequency of a radio-frequency signal and having a form in which the coil axes surround a central portion along the plane, a resonance portion that resonates with a radio-frequency signal having the predetermined frequency which is supplied from a feed end and that is connected to one end of the strip-like coil at a location corresponding to an anti-node of a standing wave of a voltage by the resonance; and a ground provided on one side of the strip-like coil that is opposite to the coupling direction, wherein an other end of the strip-like coil is grounded, and the strip-like coil performs contactless communication by producing coupling by a longitudinal wave electric field which vibrates in the coupling direction at the central portion and a winding direction of the strip-like coil is reversed at the middle of the strip-like coil.

* * * * *